US009155375B2

(12) United States Patent
Murrey

(10) Patent No.: US 9,155,375 B2
(45) Date of Patent: Oct. 13, 2015

(54) CUSTOMIZABLE ATTACHABLE ARTICLE WITH INTEGRATED POCKET AND BEVERAGE CONTAINER KIT

(71) Applicant: Russel Murrey, Valrico, FL (US)

(72) Inventor: Russel Murrey, Valrico, FL (US)

( * ) Notice: Subject to any disclaimer, the term of this patent is extended or adjusted under 35 U.S.C. 154(b) by 139 days.

(21) Appl. No.: 14/018,083

(22) Filed: Sep. 4, 2013

(65) Prior Publication Data

US 2015/0060502 A1 Mar. 5, 2015

(51) Int. Cl.
*A45F 3/20* (2006.01)
*A45F 3/16* (2006.01)

(52) U.S. Cl.
CPC ..... *A45F 3/20* (2013.01); *A45F 2003/166* (2013.01)

(58) Field of Classification Search
CPC ..... A45F 3/20; A45F 2003/166
See application file for complete search history.

(56) References Cited

U.S. PATENT DOCUMENTS 298,985 A * 5/1884 Kimball ..... 2/49.2
4,139,130 A * 2/1979 Glusker et al. ..... 224/148.2
4,806,021 A * 2/1989 Koudstaal et al. ..... 383/40
4,979,657 A * 12/1990 Espiritu ..... 224/549
5,116,105 A 5/1992 Hong
5,188,283 A * 2/1993 Gu ..... 229/103.1
5,207,362 A * 5/1993 Janus et al. ..... 224/148.2
5,207,719 A * 5/1993 Janus ..... 224/148.2
5,261,532 A * 11/1993 Fauci ..... 206/218
5,564,591 A * 10/1996 Christine et al. ..... 220/705
5,645,404 A * 7/1997 Zelenak ..... 417/1
5,884,758 A 3/1999 Sigouin et al.
6,375,001 B1 * 4/2002 Beach ..... 206/217
6,652,144 B2 * 11/2003 Stefandl ..... 383/38
6,666,360 B1 * 12/2003 Swank ..... 224/148.2
6,854,888 B1 * 2/2005 Brown et al. ..... 383/80
6,912,825 B2 * 7/2005 Kothari ..... 53/133.2
7,150,734 B2 * 12/2006 Lecointe ..... 604/408
7,823,802 B1 * 11/2010 Roche et al. ..... 239/33
7,896,199 B2 * 3/2011 Kaczmarek ..... 222/94
2002/0014498 A1 * 2/2002 Forsman et al. ..... 222/92
2008/0169321 A1 * 7/2008 Fidrych et al. ..... 224/148.2
2011/0101050 A1 * 5/2011 Parazynski et al. ..... 224/148.2
2013/0146161 A1 * 6/2013 Herivel et al. ..... 137/565.01
2014/0061273 A1 * 3/2014 Bullivant et al. ..... 224/576
2014/0263438 A1 * 9/2014 Macler ..... 222/92
2014/0353187 A1 * 12/2014 Murrey ..... 206/316.3

* cited by examiner

*Primary Examiner* — Brian D Nash
(74) *Attorney, Agent, or Firm* — Joseph T. Daniel, Esq.; Daniel Law Offices, P.A.

(57) ABSTRACT

A customizable attachable article with integrated pocket and beverage container kit includes a printable and attachable article having a main body that includes an adhesive material and removable covering layer disposed along the back surface, and a pocket disposed along the front surface. The kit also includes a disposable beverage container positioned within the pocket, and an elongated straw having a first end located within the beverage container, and a second end located above the pocket.

17 Claims, 7 Drawing Sheets

CUSTOMIZABLE ATTACHABLE ARTICLE WITH INTEGRATED POCKET AND BEVERAGE CONTAINER KIT

TECHNICAL FIELD

The present invention relates generally to the field of ornamentation and event merchandise, and more particularly to an adhesive backed customizable article for clothing that has a disposable beverage container stored within an integrated pocket.

BACKGROUND

The statements in this section merely provide background information related to the present disclosure and may not constitute prior art.

Each year, millions of individuals pack venues across the globe to view events ranging from sports to music festivals. While in attendance, these individuals typically purchase a variety of beverages ranging from soda to alcohol, for example. However, many event venues do not provide beverage holders that are integrated into the seats; therefore, it is not uncommon for users to spill a recently purchased beverage all over themselves or other event goers. Such a happenstance causes distress to the user, who must now purchase another beverage, and can also be a hazard to others who may slip and become injured from the spilled beverage.

In addition to the above, many event goers want to keep their hands free so as to be able to fully participate in the festivities. For this reason, there has been a rise in the number of event goers who bring their own attachable water bottles and/or hydration backpacks, for example. Unfortunately, these products are often not allowed at events that prefer to require all event goers purchase beverages and other themed souvenirs from vendors at the event.

As noted above, merchandise sold at events typically include event specific designs that incorporate details such as the performer/team names, color schemes, dates and the like. These products must be finalized weeks in advance to ensure that all event merchandise items can be manufactured and shipped to the venue in time for the event. Additionally, great care must be taken by merchants to accurately anticipate crowd levels, projected sales, and other such factors to ensure they are not left with unsold merchandise after the event has concluded.

Although there are known products such as iron-on patches, for example, which can include event details and be created on-demand during the event, these items are not generally popular, as they cannot be customized to suit the end user (e.g., to include a user's name), and cannot be secured to the users existing clothing without permanently altering the same.

Accordingly, it would be beneficial to provide a customizable and attachable article with an integrated pocket for a disposable beverage container, and a kit which includes the article and the beverage container, that can allow users to enjoy beverages at events without suffering from the above noted drawbacks.

It would be further beneficial if the article can be customized to include both event details and customer-desired details that can be worn by users without causing permanent damage to their existing clothing.

SUMMARY OF THE INVENTION

The present invention is directed to a customizable attachable article with integrated pocket and beverage container kit.

One embodiment of the present invention can include an attachable article having a main body that includes an adhesive material and removable covering layer disposed along the back surface, and a pocket disposed along the front surface. The main body and pocket being constructed from a durable material and including a size which can be utilized with a conventional printer. The main body being attachable to an article of clothing and the pocket includes a size that is suitable for receiving a disposable beverage container. The invention can also include a disposable beverage container positioned within the pocket, and an elongated straw having a first end located within the beverage container and a second end located above the pocket.

Another embodiment of the present invention can include a method of providing the kit described above.

This summary is provided merely to introduce certain concepts and not to identify key or essential features of the claimed subject matter.

BRIEF DESCRIPTION OF THE DRAWINGS

Presently preferred embodiments are shown in the drawings. It should be appreciated, however, that the invention is not limited to the precise arrangements and instrumentalities shown.

DETAILED DESCRIPTION OF THE INVENTION

Figure 1:
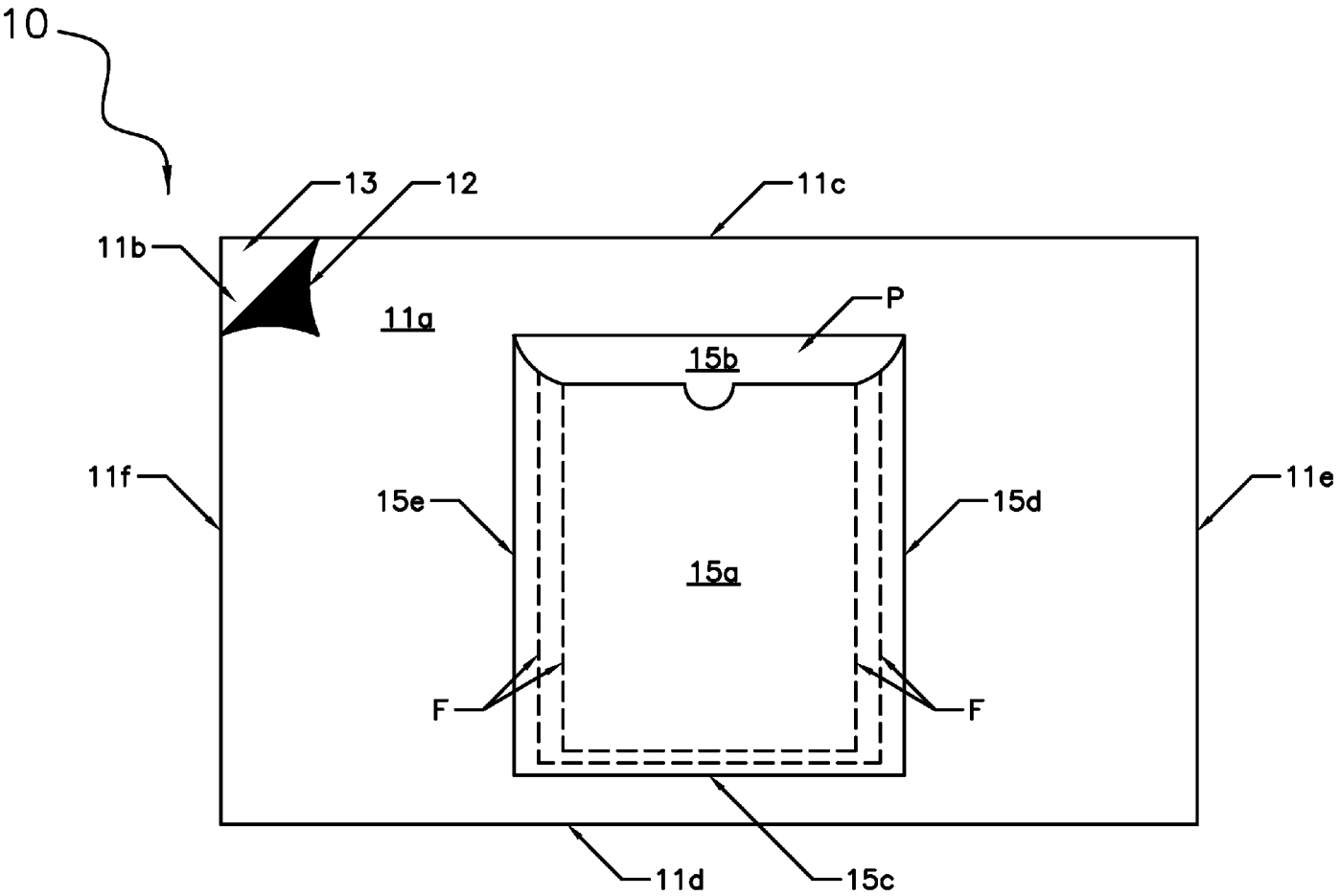
FIG. 1 is a frontal view of a customizable attachable article with integrated beverage pocket that is useful for understanding the inventive concepts disclosed herein.

While the specification concludes with claims defining the features of the invention that are regarded as novel, it is believed that the invention will be better understood from a consideration of the description in conjunction with the drawings. As required, detailed embodiments of the present invention are disclosed herein; however, it is to be understood that the disclosed embodiments are merely exemplary of the invention which can be embodied in various forms. Therefore, specific structural and functional details disclosed herein are not to be interpreted as limiting, but merely as a basis for the claims and as a representative basis for teaching one skilled in the art to variously employ the inventive arrangements in virtually any appropriately detailed structure. Further, the terms and phrases used herein are not intended to be limiting but rather to provide an understandable description of the invention.

Identical reference numerals are used for like elements of the invention or elements of like function. For the sake of clarity, only those reference numerals are shown in the individual figures which are necessary for the description of the respective figure. For purposes of this description, the terms "upper," "bottom," "right," "left," "front," "vertical," "horizontal," and derivatives thereof shall relate to the invention as oriented in FIG. 1.

As described throughout this document, the term "event indicia" can include, without limitation, any type of decorative elements such as colors, markings, words, shapes, symbols, logos, designs, types of materials, lights, patterns, images, lithographs and photographs, for example. To this end, the event indicia can be tailored to a specific event having pre-approved themes, or can be customized to suit the particular interests of an end user, to include personal items such as the users name, dates and personal messages, for example.

Additionally, the term "venue" can include any location such as an arena, stadium, store, mall, home or office where the article may be shipped, stored and/or sold to consumers.

FIG. 1 illustrates one embodiment of a customizable attachable article with integrated beverage container pocket 10 that is useful for understanding the inventive concepts disclosed herein. As shown, the article can include a main body 11 having a peel and stick backing and at least one pocket for storing a disposable beverage container.

The main body 11, can be custom printed with event indicia and can be removably attached to an article of the users clothing. To this end, the main body can include a top surface 11*a*, a back surface 11*b*, a top edge 11*c*, a bottom edge 11*d* and a pair of opposing side edges 11*e* and 11*f*. As the main body is designed to be adhered to an article of clothing in a peel-and-stick manner, an adhesive material 12 and removable covering layer 13 can also be provided.

The pocket 15 can include, essentially, an envelope having a front side member 15*a* and a back side member 15*b* that are bound together by a bottom edge 15*c* and a pair of opposing side edges 15*d* and 15*e* to form a pocket cavity P having an open top edge for receiving a disposable beverage container 30 described below. In the preferred embodiment, the shape of the pocket 15 will be complementary to the shape of the beverage container, so as to ensure a snug fit. To this end, the side and bottom edges 15*c*-15*e* can include any number of folds F in order to increase or decrease the size of the pocket, so as to accommodate the beverage container in a secure manner, while the article 10 is being worn by a user.

In the preferred embodiment, the main body can be constructed from a single sheet of 8.5×11 inch synthetic soft polyester paper which is known to include waterproof and static resistant features. Additionally, as synthetic polyester paper is essentially a hybrid between traditional paper and cloth, it is well known to be extremely durable and to maintain printed images and the like (e.g., event indicia) for extremely long periods of time without fading or bleeding. As is known to those of skill in the art, synthetic paper is compatible with commercially available laser and ink jet printers without requiring modification of any kind.

The pocket 15 can preferably be constructed from a substantially identical material as the main body 11, and can be constructed so as to be completely flat when no secondary items are stored within the pocket itself. In one preferred embodiment, the pocket 15 can be formed as an integral part of the main body at a time of initial construction, in accordance with known manufacturing techniques. Alternatively, the pocket 15 can be manufactured separately from the main body, and can be secured to the main body using any number of commercially available adhesives such as glue or double-sided tape, for example. Of course, any number of other shapes, sizes, construction materials and means for attachment to the main body can also be utilized.

Figure 2:
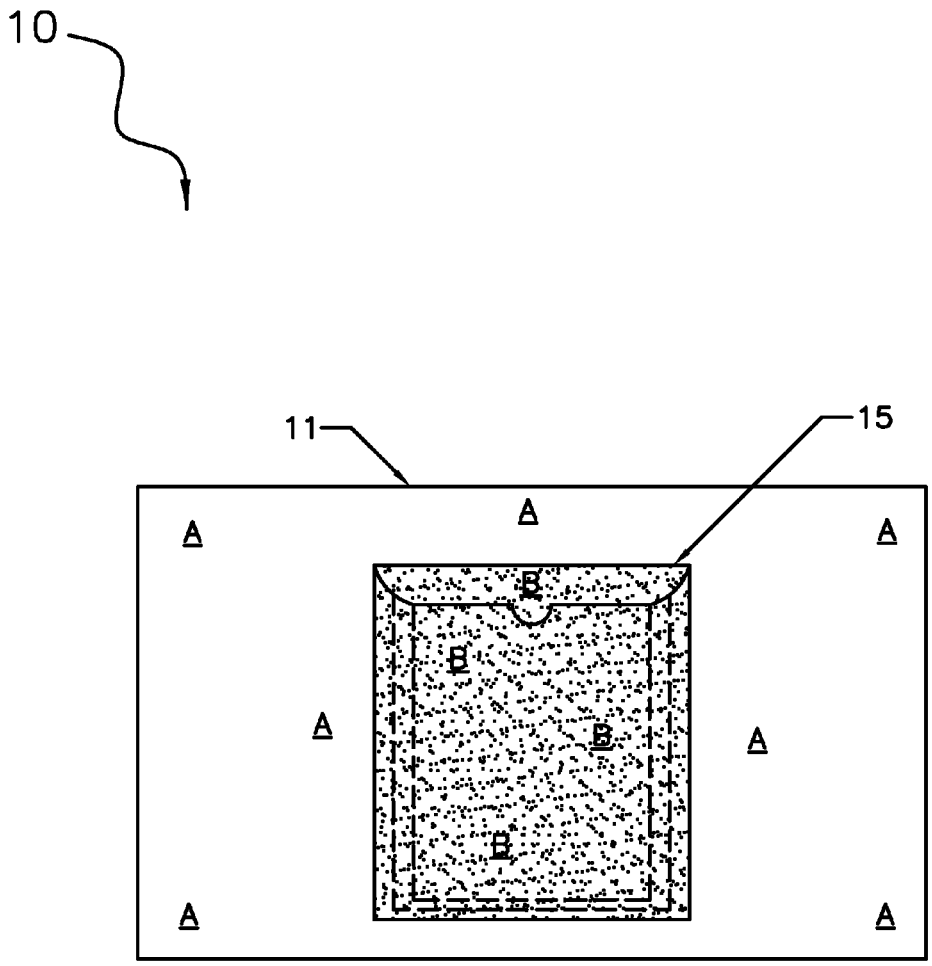
FIG. 2 is a front view of the customizable attachable article with integrated beverage pocket, in accordance with another embodiment of the invention.

As shown in FIG. 2, by providing a flat pocket 15 on the main body 11, the entire article 10 can be fed into a conventional printer in order to receive any number of event indicia A and B. To this end, the main body and the pocket can be imprinted with identical indicia, or can be imprinted with different indicia. For example, the indicia imprinted onto the pocket area may correlate to a particular flavor beverage stored within the beverage container 30 described below, and can therefore be used as a promotional item.

Figure 3:
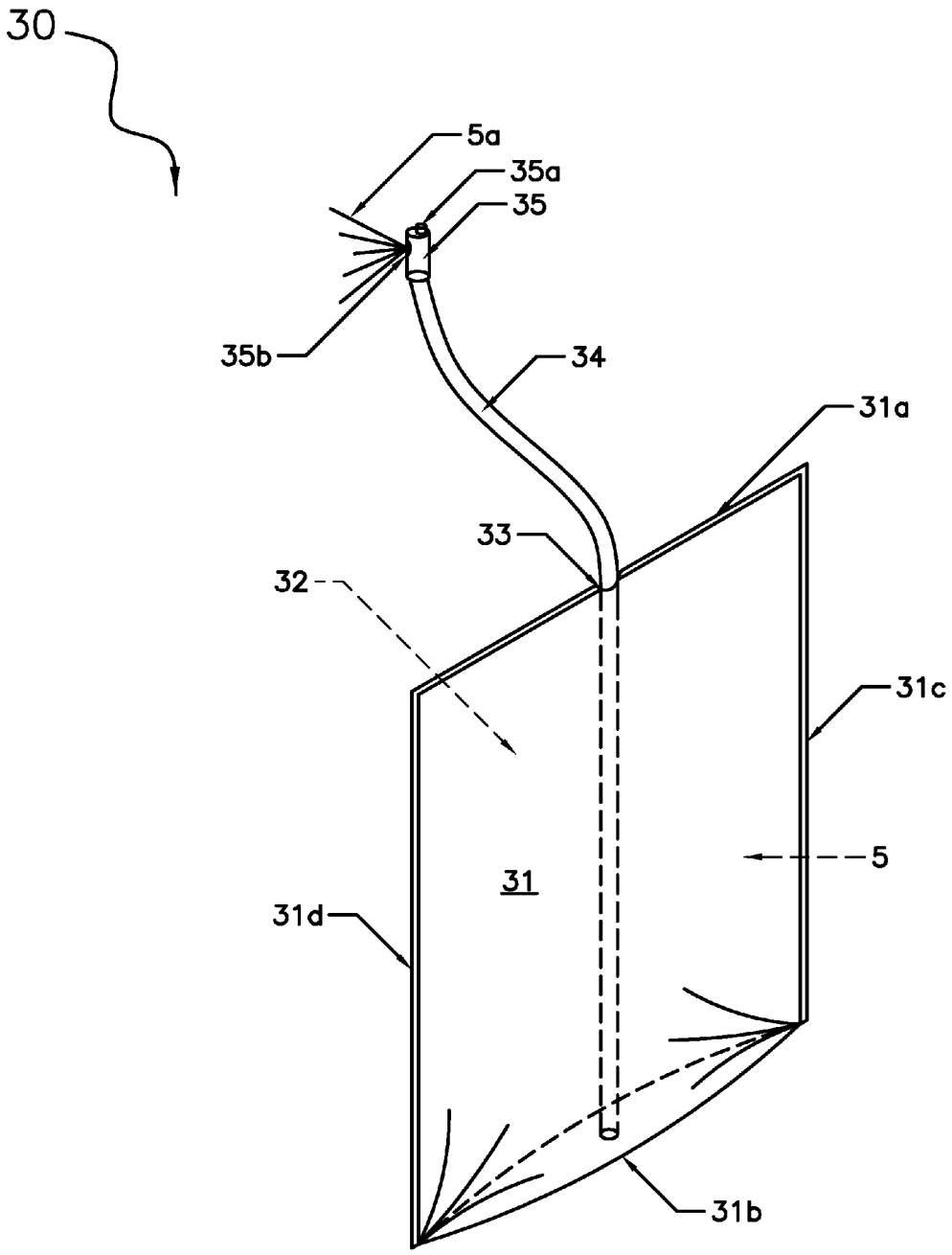
FIG. 3 is a perspective view of a disposable beverage container which can be utilized with the customizable attachable article with integrated beverage pocket.

FIG. 3 illustrates one suitable embodiment of a disposable beverage container 30 which can be provided with the device 10 to form a hands free attachable customizable beverage kit. As shown, the beverage container can include a main body 31 that is preferably constructed as a plastic film liquid pouch having a plurality of sealed walls 31*a*-31*d* defining an internal chamber 32 for holding a beverage 5. An opening 33 can be provided to receive an elongated straw 34 having an integrated spray/mist nozzle 35 at one end. Spray/mist nozzles are extremely well known in the art and include a push button mechanism 35*a* capable of introducing air into the provided liquid to discharge a mist 5*a* (also referred to as atomizing) from the nozzle end 35*b*.

Although described above as including a spray nozzle 35, other embodiments where the spray nozzle is not included, and the spray includes a traditional open end are also contemplated. Moreover, although described with a specific shape and construction material, this is for illustrative purposes only, as any number of disposable beverage containers can also be utilized herein. Several non-limiting examples include U.S. Pat. Nos. 5,116,105 and 5,884,758, for example, the contents of each of which are incorporated herein by reference.

Figure 4:
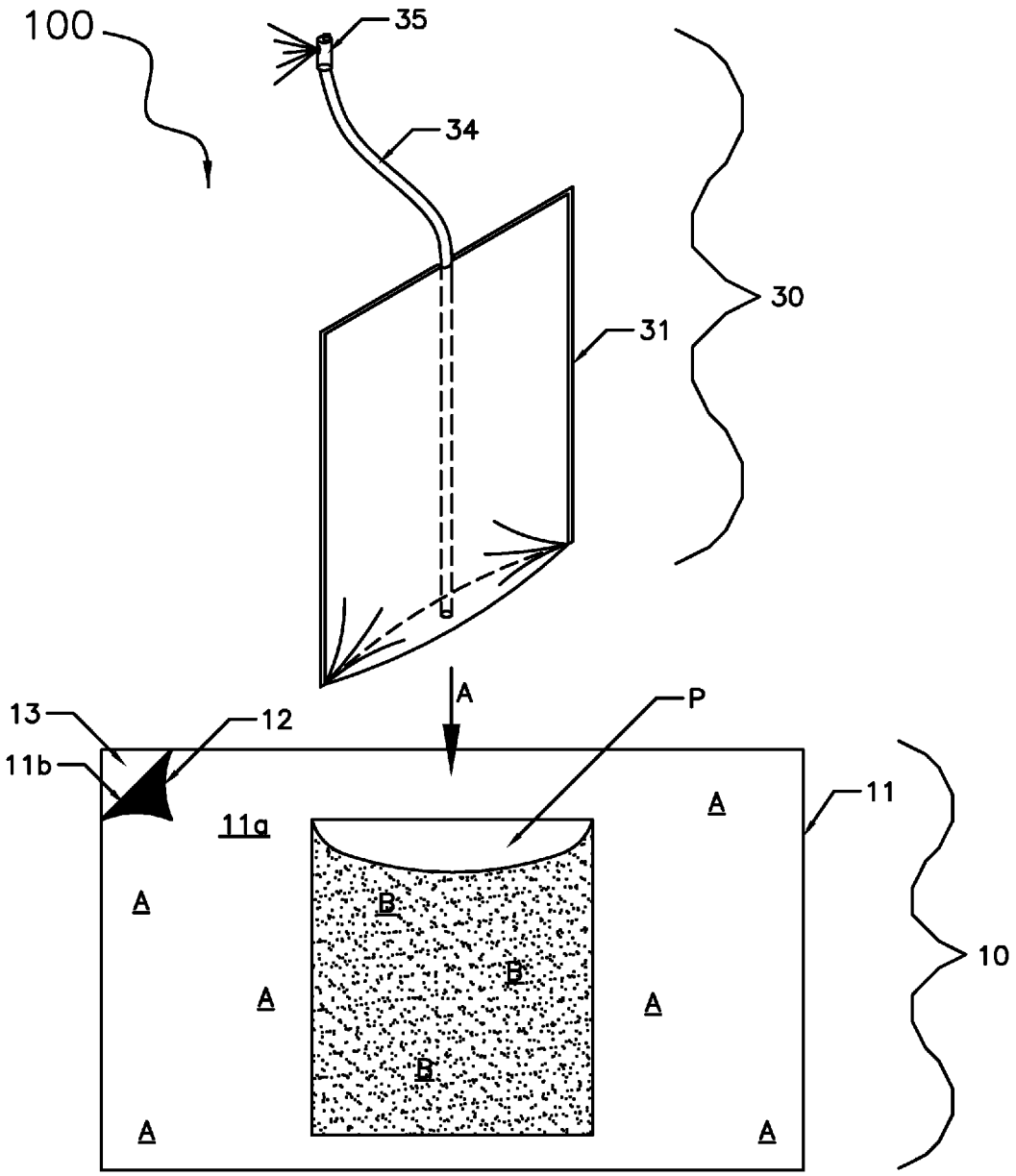
FIG. 4 is a perspective view of a kit which includes the customizable attachable article with beverage pocket and the disposable beverage container, in accordance with one embodiment of the invention.
Figure 5:
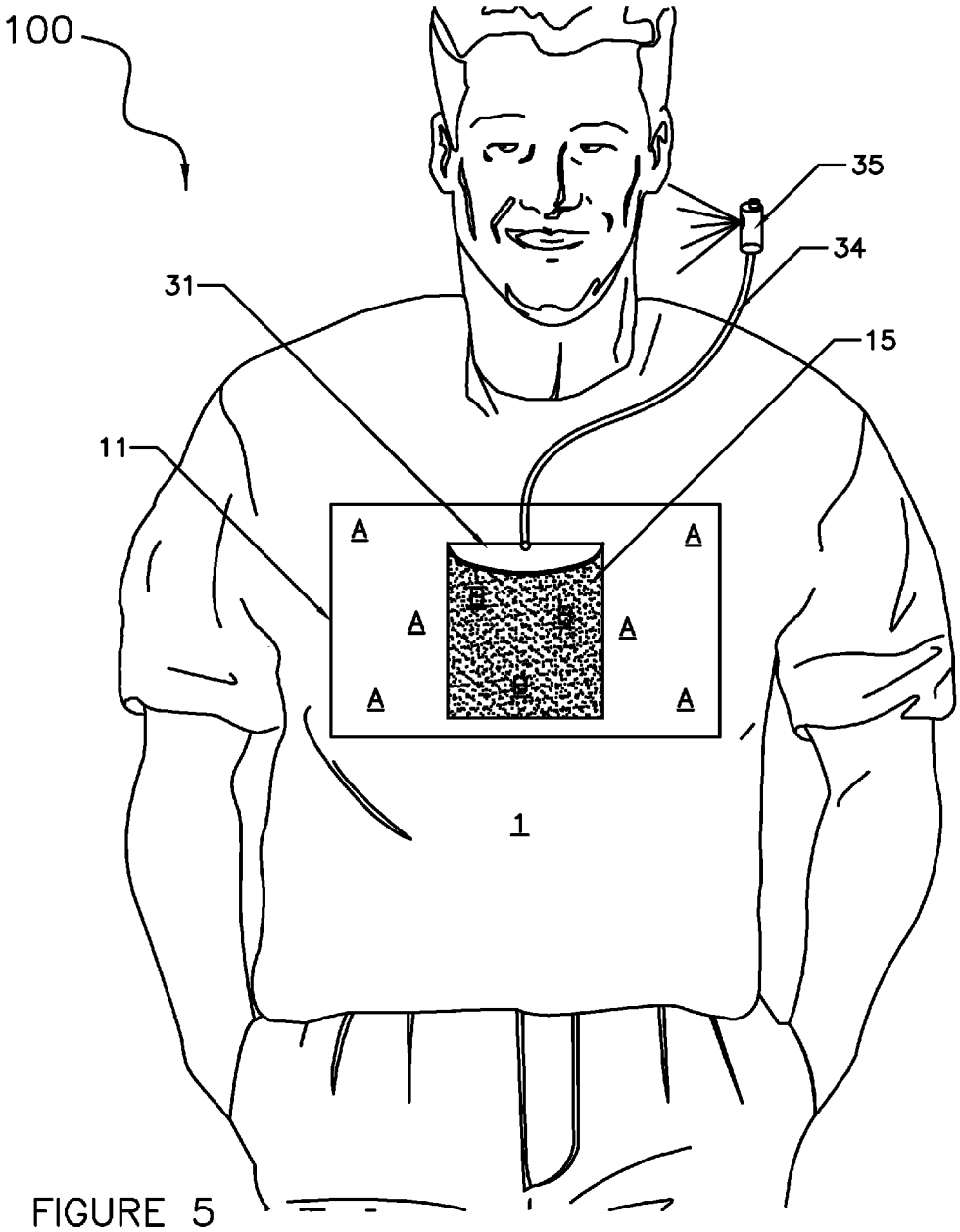
FIG. 5 illustrates one embodiment of the kit in operation, in accordance with one embodiment of the invention

FIGS. 4 and 5 illustrate one embodiment of a kit 100 that includes the article 10 and beverage container 30 described above, in operation and a method of utilizing the same.

As described above, the originally blank article 10 can first be imprinted with any number of desirable event indicia A and B. This indicia can be custom printed based on the likes of the purchaser, or can be pre-printed with any number of event details and the like. Once a user selects their desired article, they can select a beverage container 30 that can be pre-filled with any number of desired beverages 5. Next, the container 30 can then be slid into the pocket cavity P of the article 10 (See arrow a), and the main body 11 can be separated from the peel and stick backing 13. Finally, the user 1 can adhere the assembled article onto their shirt at any desirable location, and position the straw 34 and/or spray nozzle 35 at a convenient location for easy access.

When so positioned, the user can experience the benefits of wearing event indicia without damaging their clothing, and simultaneously be provided with a beverage of their choice which can be carried and enjoyed in a hands free manner.

Figure 6:
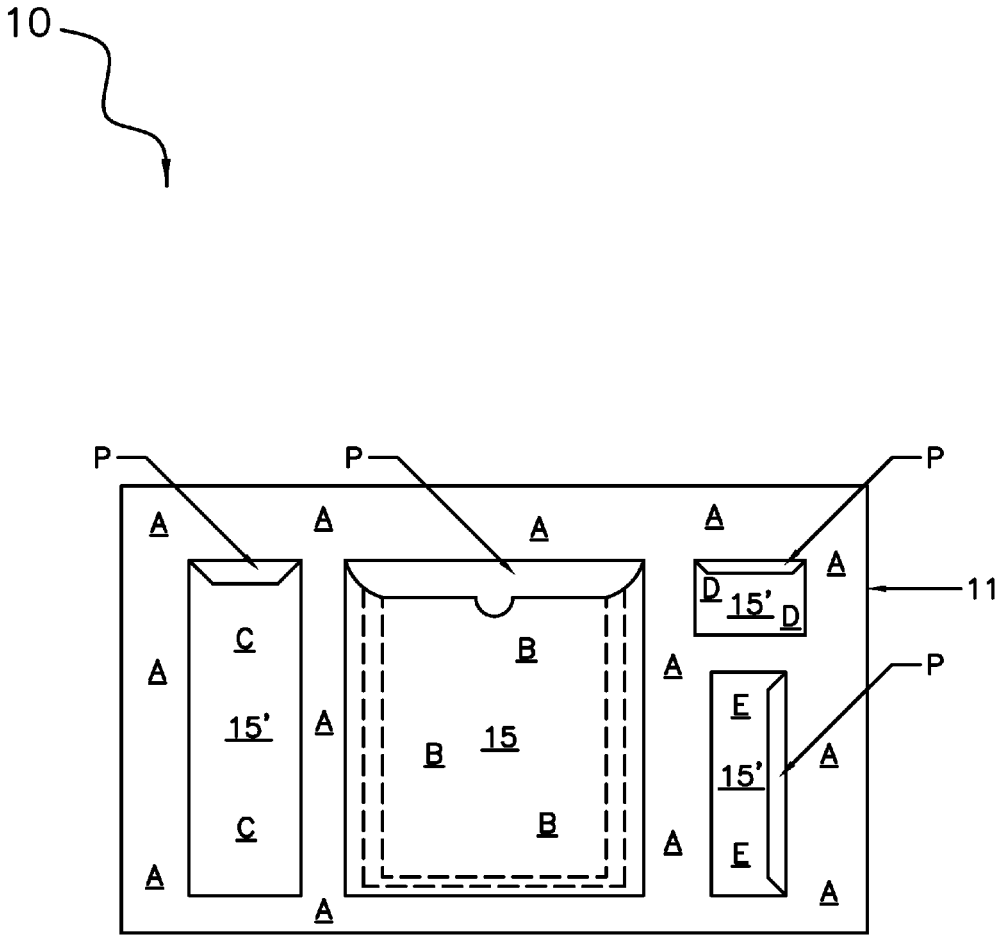
FIG. 6 is a front view of the customizable attachable article with integrated beverage pocket, in accordance with an alternate embodiment of the invention.

Although described above as including a single pocket 15, this is for illustrative purposes only. To this end, FIG. 6 illustrates one embodiment of the article 10 that further includes a plurality of additional pockets 15'. As shown, these pockets can be located anywhere along the main body and can be used to store any number of items which may or may not be sold with the kit. These items can include, for example, walkie-talkies, radios, headphones, and other such goods commonly sold or rented at events.

To this end, with each additional pocket, the article can also include one or more additional event indicia A, B, C, D. Moreover, although described above as being printed at the venue, this is but one preferred method of distribution, as the articles can also be pre-printed at the location of manufacture and shipped to the venue.

Figure 7:
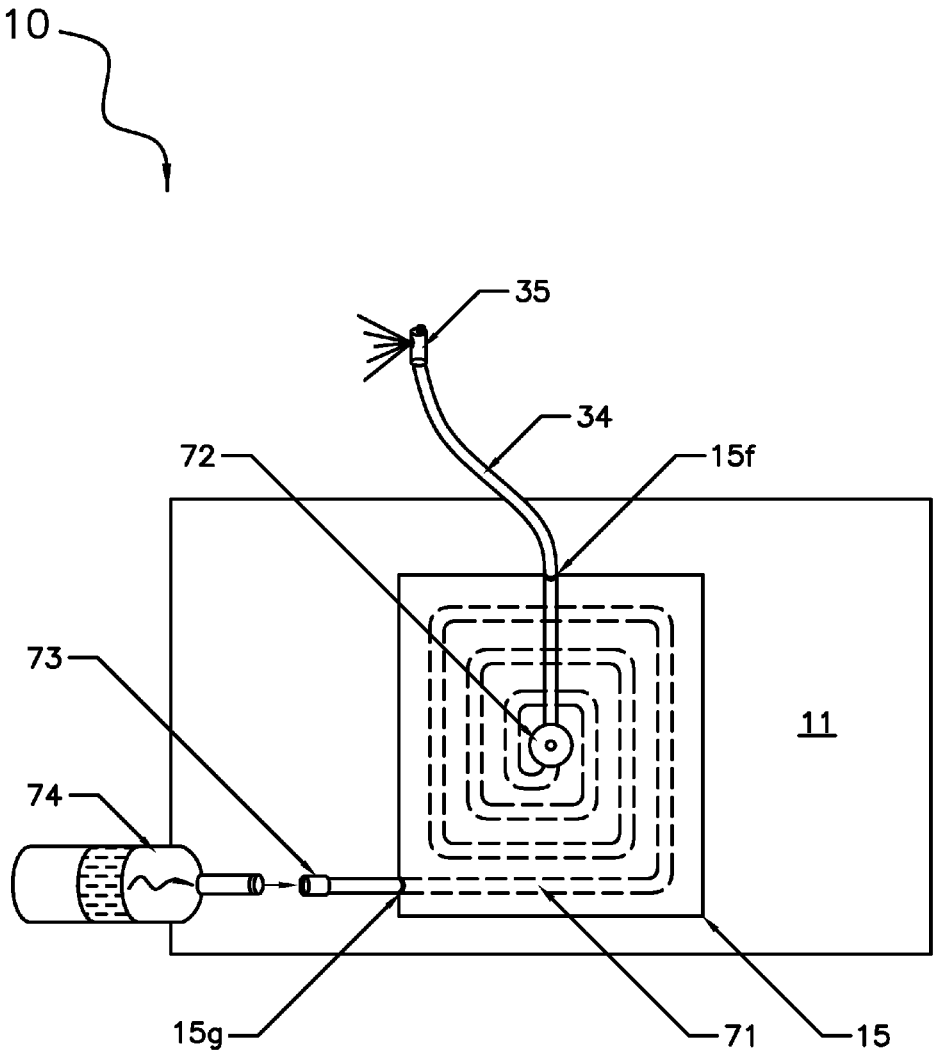
FIG. 7 is a top view of an alternate embodiment of the beverage container which contains an elongated tubular bladder straw in the place of a bladder.

FIG. 7 illustrates an alternate embodiment wherein the bladder is replaced with an elongated tubular bladder straw 71 that is disclosed within the pocket 15. As shown, the straw can be bent around in a winding pattern to a center point 72. A one way valve 73 can be disclosed on the end of the bladder straw 71 for insertion into a bottle 74, as illustrated. With the use of suction or using a motor device (not shown), the liquid from the bottle can be drawn up and into the tube. In this manner, the bladder tube 71 can be refillable and therefore reusable. On the other end of the bladder tube 71 are the elongated straw 34 and a spray/mist nozzle 35, such as a bulb syringe type sprayer, for example. As shown, the pocket 15 can further include openings 15*f* and 15*g* for receiving the bladder and straw.

Accordingly, the inventive concepts disclosed herein function to allow a virtually unlimited number of articles to be initially produced in a blank state (i.e., without indicia), and shipped in bulk to venues across the globe. Upon purchase by a consumer, each unit can be imprinted with custom and/or event specific indicia at the event. Accordingly, the above noted article and method alleviates the previous concern relating to overstocking expired merchandise, and is much more environmentally friendly as the waste associated with such expired merchandise is eliminated.

As to a further description of the manner and use of the present invention, the same should be apparent from the above description. Accordingly, no further discussion relating to the manner of usage and operation will be provided.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A kit comprising:

a customizable attachable article that includes a singular main body material having a front surface and back surface, an adhesive material and removable covering layer disposed along the entirety of the back surface, said material functioning to adhere to an article of clothing in a peel and stick manner without causing damage to the same, and a pocket disposed along the front surface of the main body;

a disposable beverage container that is disposed within the pocket; and an elongated straw having a first end located within the beverage container, and a second end located above the pocket, wherein the pocket includes a shape and dimension that is complementary to the beverage container, and each of the main body and the pocket are constructed from a single piece of waterproof static resistant paper that is compatible with a commercially available printer.

2. The kit of claim 1, further comprising:

a liquid beverage disposed within the disposable container.

3. The kit of claim 2, further comprising:

a push button mist nozzle disposed along the second end of the straw, said nozzle functioning to create a mist for delivering the beverage within the container to a user.

4. The kit of claim 1, wherein the pocket is secured onto the main body in a generally flat manner, and further comprises a plurality of folds configured to expand a size of the pocket.

5. The kit of claim 1, wherein each of the main body and the pocket are formed from a single sheet of soft polyester paper.

6. The kit of claim 1, wherein each of the main body and the pocket are formed from a single sheet of 8.5×11 inch printer ready synthetic polyester paper.

7. The kit of claim 1, wherein each of the main body and the pocket include identical event indicia.

8. The kit of claim 1, wherein each of the main body and the pocket include different event indicia.

9. A kit comprising:

a customizable attachable article that includes a singular main body material having a front surface and back surface, an adhesive material and removable covering layer disposed along the entirety of the back surface, said material functioning to adhere to an article of clothing in a peel and stick manner without causing damage to the same, and a pocket disposed along the front surface of the main body; and a disposable beverage container that is disposed within the pocket, said beverage container comprising an elongated tubular member having a valve at one end, and an elongated straw at another end, wherein the pocket includes a shape and dimension that is complementary to the beverage container, and each of the main body and the pocket are constructed from a single piece of waterproof static resistant paper that is compatible with a commercially available printer.

10. The kit of claim 9, wherein the valve includes a one-way valve having a shape and dimension suitable for mating with a beverage container and removing a liquid therefrom.

11. The kit of claim 9, further comprising:

a liquid beverage disposed within the disposable container.

12. The kit of claim 11, further comprising:

a push button mist nozzle disposed along a second end of the straw, said nozzle functioning to create a mist for delivering the beverage within the container to a user.

13. The kit of claim 9, wherein the pocket is secured onto the main body in a generally flat manner, and further comprises a plurality of folds configured to expand a size of the pocket.

14. The kit of claim 9, wherein each of the main body and the pocket are formed from a single sheet of soft polyester paper.

15. The kit of claim 9, wherein each of the main body and the pocket are formed from a single sheet of 8.5×11 inch printer ready synthetic polyester paper.

16. The kit of claim 9, wherein each of the main body and the pocket include identical event indicia.

17. The kit of claim 9, wherein each of the main body and the pocket include different event indicia.

* * * * *